US006581335B2

(12) United States Patent
Grant

(10) Patent No.: US 6,581,335 B2
(45) Date of Patent: Jun. 24, 2003

(54) LIGHTED POST CAP

(76) Inventor: Darcey Grant, 100 Chelsea, Kingsville, Ontario (CA), N9Y 3X4

( * ) Notice: Subject to any disclaimer, the term of this patent is extended or adjusted under 35 U.S.C. 154(b) by 0 days.

(21) Appl. No.: 09/835,167

(22) Filed: Apr. 13, 2001

(65) Prior Publication Data

US 2002/0148183 A1 Oct. 17, 2002

(51) Int. Cl.[7] ..... E04H 14/00; E04H 12/00; F21S 8/08

(52) U.S. Cl. ..... 52/28; 52/300; 52/301; 362/414

(58) Field of Search ..... 52/28, 300, 301, 52/465, 466, 469; 256/1, 11, 19, 59; 362/414, 431, 312, 314

(56) References Cited

U.S. PATENT DOCUMENTS 164,979 A * 6/1875 Davenport ..... 126/39 B
3,256,659 A * 6/1966 Dudoff ..... 52/239
3,506,243 A * 4/1970 Seiler ..... 256/59
4,703,403 A * 10/1987 Smith et al. ..... 362/268
4,722,514 A * 2/1988 Pettit ..... 256/19
5,853,167 A * 12/1998 West et al. ..... 256/19
5,934,035 A * 8/1999 Rasmussen et al. ..... 256/19
6,328,457 B1 * 12/2001 Huang ..... 362/226
6,330,998 B1 * 12/2001 Roy ..... 256/19

* cited by examiner

*Primary Examiner*—Carl D. Friedman
*Assistant Examiner*—Kevin McDermott
(74) *Attorney, Agent, or Firm*—Harness, Dickey & Pierce, P.L.C.

(57) ABSTRACT

A post cap assembly having a body including a generally vertical side defining an interior volume. A one locating member projecting into the interior volume and having a stop formed thereon for positioning the post cap on a support. Furthermore, the post cap having an upper portion to selectively receive a light source. The light source reflected down over and substantially illuminating only the sides of the post cap through apertures selectively formed in eaves on the tops of the sides.

20 Claims, 5 Drawing Sheets

LIGHTED POST CAP

FIELD OF THE INVENTION

This present invention relates generally to post caps, and more particularly to lighted post caps for residential use.

BACKGROUND OF THE INVENTION

For many landscaping and architectural purposes, lighted fixtures and structures are placed to help illuminate paths and to add aesthetic appeal. In particular, lights may generally include lanterns placed on posts, small candles, or small low voltage lighted stakes. Other accompaniments may be added to these lighted structures to increase their aesthetic appeal or the usefulness of the light structure.

Often, however, low voltage lighting systems are placed on stakes which are low to the ground and provide a low spread of illumination for a pathway or to light particular landscaping features. Taller or larger lamps are also known which are conventionally mounted in one location and provide a great amount of light that radiates generally spherically from the light source to cover a large area in the case of a flood light or a narrow directed beam in the case of a spotlight. Furthermore, such items as lawn torches provide a more temporary light source and also include an open flame or a hot light source.

Commonly known light sources especially for residential structures are particularly related to lighting an area or another structure. In addition, commonly known light sources require a separate, free standing mounting pole or post upon which to place the light source. Furthermore, the mounting pole or post is usually in addition to any other structures which may be placed around a residence or other landscape and may further obstruct the landscape for which the light source is needed. Additionally, the light source is visible at all times whether energized or not.

SUMMARY OF THE INVENTION

The present invention relates to the structure and construction of a post cap which includes an open area inside the post cap structure. The inner open area of the post cap structure is adapted to receive a light source which emits a curtain of light onto the post cap through openings created in the post cap. The post cap is provided with a removable shutter for selectively adapting the post cap for unlit or lit applications.

One advantage of the present invention is the ability to selectively use the post cap in an illuminated or unilluminated capacity.

A further advantage of the present invention is its adaptability to being placed on numerous types of posts. Therefore, this advantage removes the necessity of placing an additional post in a particular landscape or area for the inclusion of an illuminating source.

A further advantage includes the ability of the present invention to receive conventional low-voltage light sources, thus negating the need to rewire current light sources which may already be in a landscape.

Another advantage includes the fact that the selectability between a simple post cap cover and an illuminating source is selectable by the final consumer of the post cap.

Yet, a further advantage is that when the post cap of the present invention is not illuminated, the light source is not visible. However, upon illuminating the light source, the light curtain effect is created. Additionally, the light source is never visible, only the light emitted is visible.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
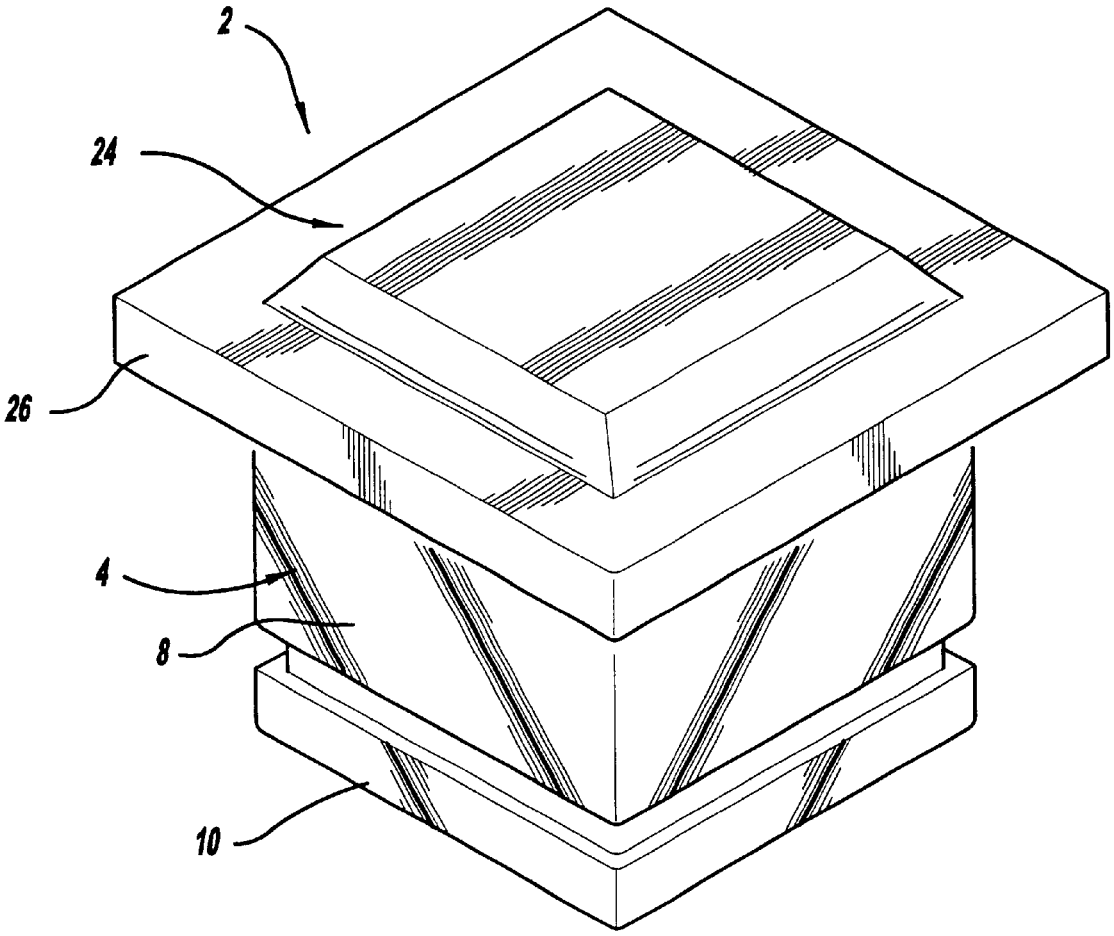
FIG. 1 is an isometric view of the post cap according to the present invention.
Figure 2:
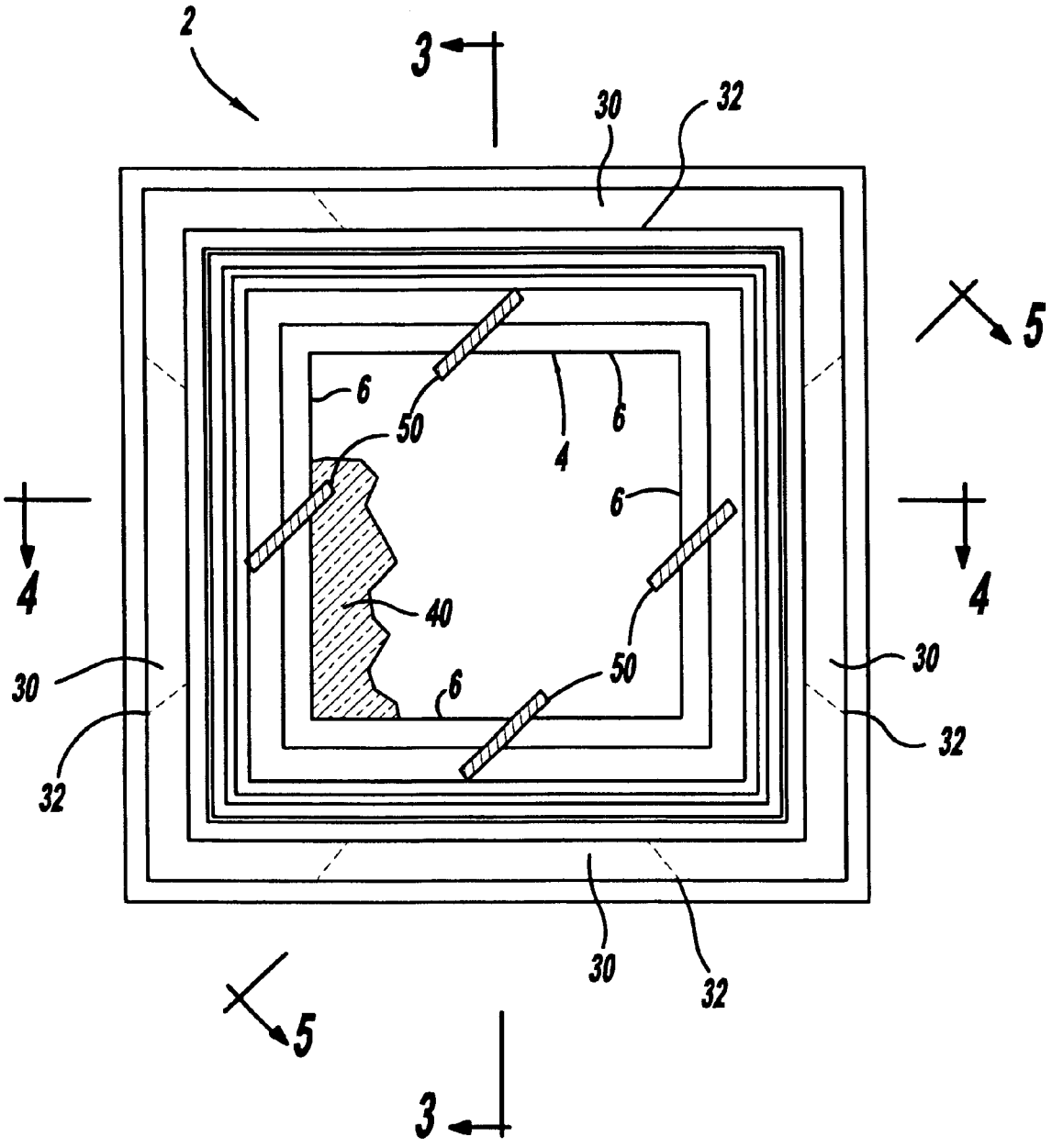
FIG. 2 is a top view of a post cap without a cover according to the present invention.
Figure 3:
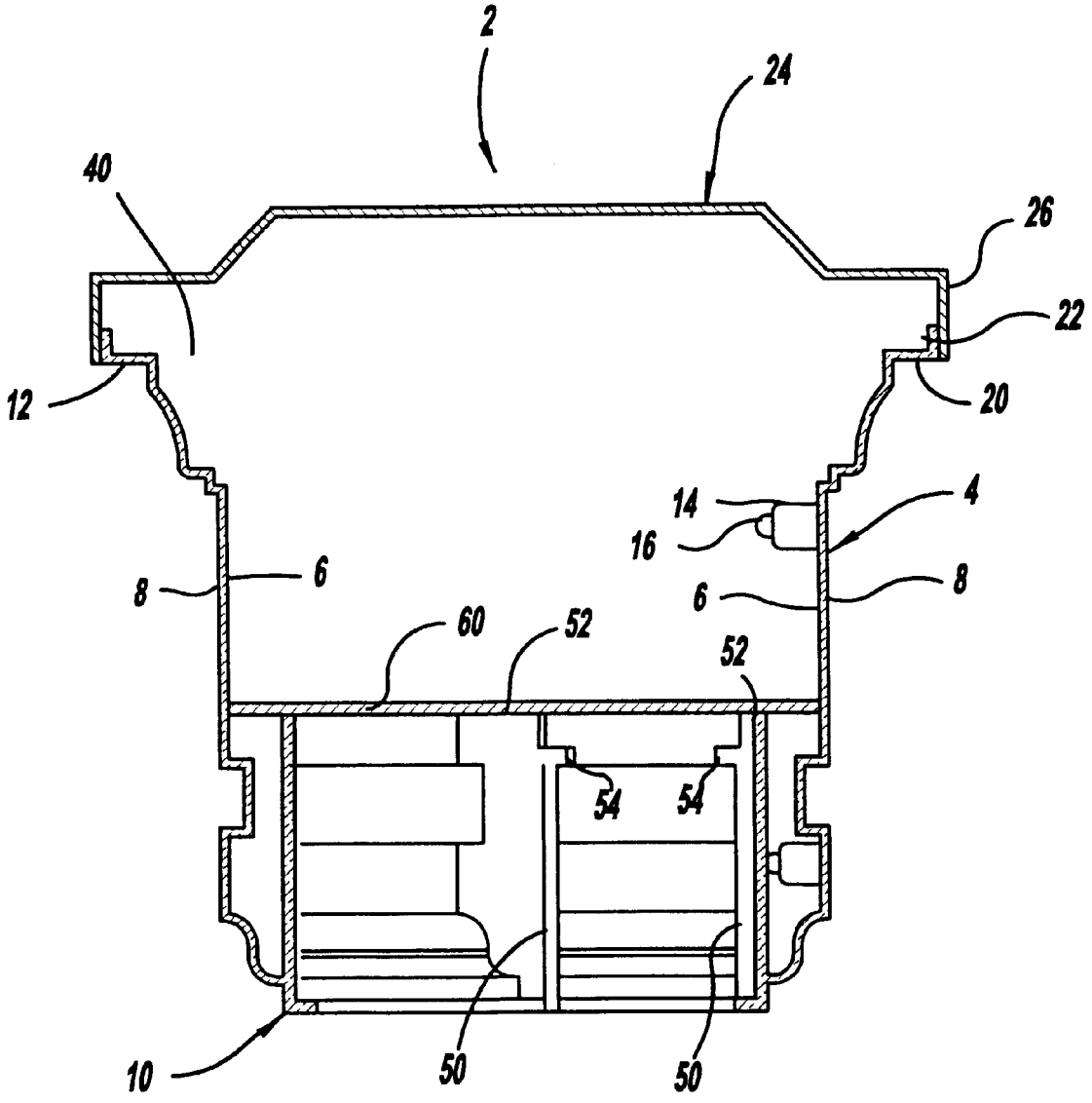
FIG. 3 is a cross section of a post cap with a cover taken along Line A—A in FIG. 2 according to the present invention.
Figure 4:
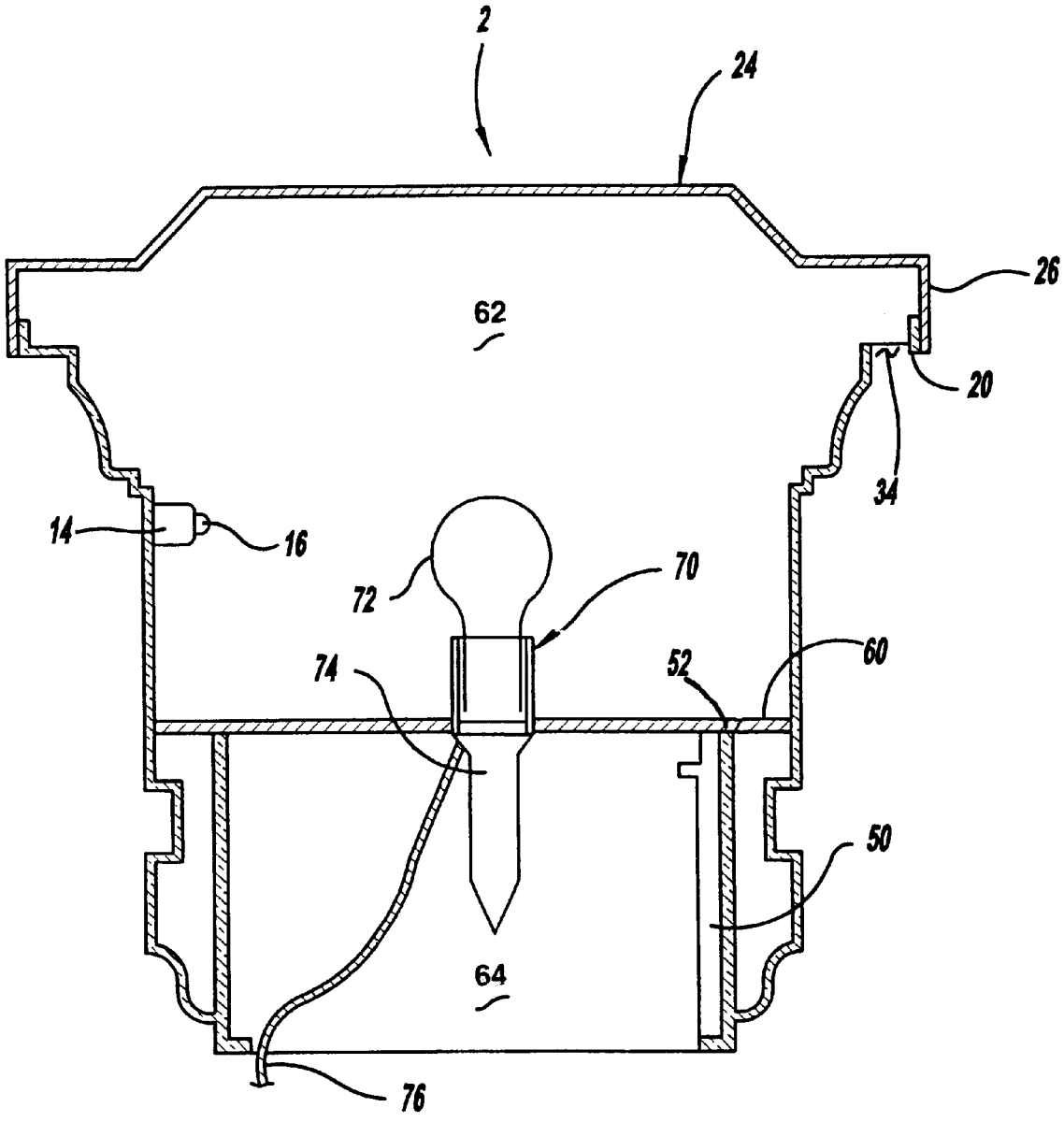
FIG. 4 is a cross section of a post cap with a lid taken along Line B—B in FIG. 2 according to the present invention.

With references to FIGS. 1–4, the post cap of the present invention is illustrated. In particular, a post cap, shown generally at 2, includes walls 4 having an interior 6 and an exterior 8. The walls 4 extend generally vertically from a bottom portion 10 to a top portion 12. With particular reference to FIGS. 3 and 4, it will be understood that the walls 4 are not necessarily planar. In particular, the walls 4 of the present invention may include ornamental or decorative features such as moldings which are understood to be independent of the utilitarian aspects of the present invention. As presently preferred, the four walls as illustrated in particular in FIG. 2 are formed in two halves. With particular references to FIGS. 3 and 4, a first section of walls may include a female or receiving member 14 while a second section of walls may include a male locking member 16. In this way, sections of the post cap 2 may be affixed to one another post production. Furthermore, a singular die may produce two mirror images that may be locked together. However, one skilled in the art will recognize that the post cap 2 may be formed as a unitary piece or in a number of pieces greater than two.

The walls 4 terminate at the top portion 12 in an eave or horizontal flange 20. The flange 20 extends generally perpendicular to the walls 4 over the exterior of the wall 8. On the outside perimeter of the flange 20 is formed therewith a secondary wall 22. The secondary wall 22 extends generally parallel to the walls 4 of the post cap 2. A cap 24 is formed to be selectively placed over the top portion 18 of post cap 2. The outer perimeter of the cap 24 includes edges 26 generally parallel to the secondary wall 22. The edges 26 of the cap 24 are only minimally greater in dimension than the secondary wall 22, therefore there is a snug or a snap fit over the secondary walls 22. Although not shown, it is understood, that the secondary wall 22 and the edge 26 of the cap 24 may also include other releasable catch or locking mechanisms to further secure the cap 24 to the secondary walls 22.

The flange 20 includes a shutter or removable portions 30 which may be selectively removed from the flange 20. With particular reference to FIG. 2, weakened regions 32 at either end of the removable portion 30 allow the removable portion 30 to be broken away from the flange 20. In this way, an aperture 34 is formed in the flange 20. The aperture may have any appropriate aspect ratio, but generally has an aspect ratio equal to or greater than 0.5:1. Thus, even when the cap 24 is placed over the post cap 2, the aperture 34 creates an open area between the interior and exterior of the post cap 2. Furthermore, a lens 40 may be placed upon the flange 20 of the post cap 2. This lens 40 acts as a barrier between the outside and the inside of the post cap 2. As presently preferred, the lens 40 is made of a translucent material to allow light from the inside of the post cap 2 to emanate towards the outside of the post cap 2.

Extending inwardly from the inside 6 of the walls 4 are locating members or ribs 50. Such locating members 50 are to position me post cap 2 on top of a post (shown at 80 in FIG. 4). The locating members 50 act as stops to locate the post cap 2 onto the post at a designated position. In addition, the locating members 50 also provide a base upon which a mounting member 60, described herein, may rest when inserted into the post cap 2. Each of the ribs 50 include a top surface 52 and a bottom surface 54. The top surface 52 provides a base to receive a platform or mounting member 60 for mounting a light source 70. The bottom surfaces 54 provide an area upon which the post cap 2 may rest when placed on a post (shown at 80 in FIG. 4). Furthermore, the top side 52 defines the bottom of the top volume 62 of a post cap 2 while the bottom surface 54 defines the upper limit of a bottom volume 64 of the post cap 2.

With particular reference to FIGS. 3 and 4, the top side 52 of the rib 50 receives a mounting member 60 which receives a light source 70. The mounting member 60 may be variably designed to include mounting areas for several different types of lights. In the preferred embodiment of the present invention, the mounting member 60 includes a bayonet mount for commonly available bayonet light sources. In particular, low voltage lights 72 which are mounted on common landscaping bayonet mounts 74 may be placed through the mounting members 60 and affixed thereto allowing wires 76 to be routed through the bottom 10 of the post cap 2. In this way, the light 74 is able to illuminate the top volume 62 of the post cap 2. When the cap 24 is placed on the post cap 2 and the light source 70 is illuminating the top volume 62 of the post cap 2 and further when a removable section 30 has been removed from the flange 20, light is allowed to emanate through the aperture 34. If the lens 40 is placed upon the flange 20, the lens 40 acts as a diffuser for the light source 70 from the interior of the post cap 2. In this way, the light source from the interior of the post cap 2 illuminates the exterior 8 of the walls 4 of the post cap 2. In particular, since the cap 24 of the post cap 2 includes vertically extending walls 26 and is reflective on its interior surface, the light from the light source 72 is reflected downwards over the exterior edge 8 of the walls 4. This is preferably referred to as a "light curtain" being formed on the exterior 8 of the walls 4.

Figure 5:
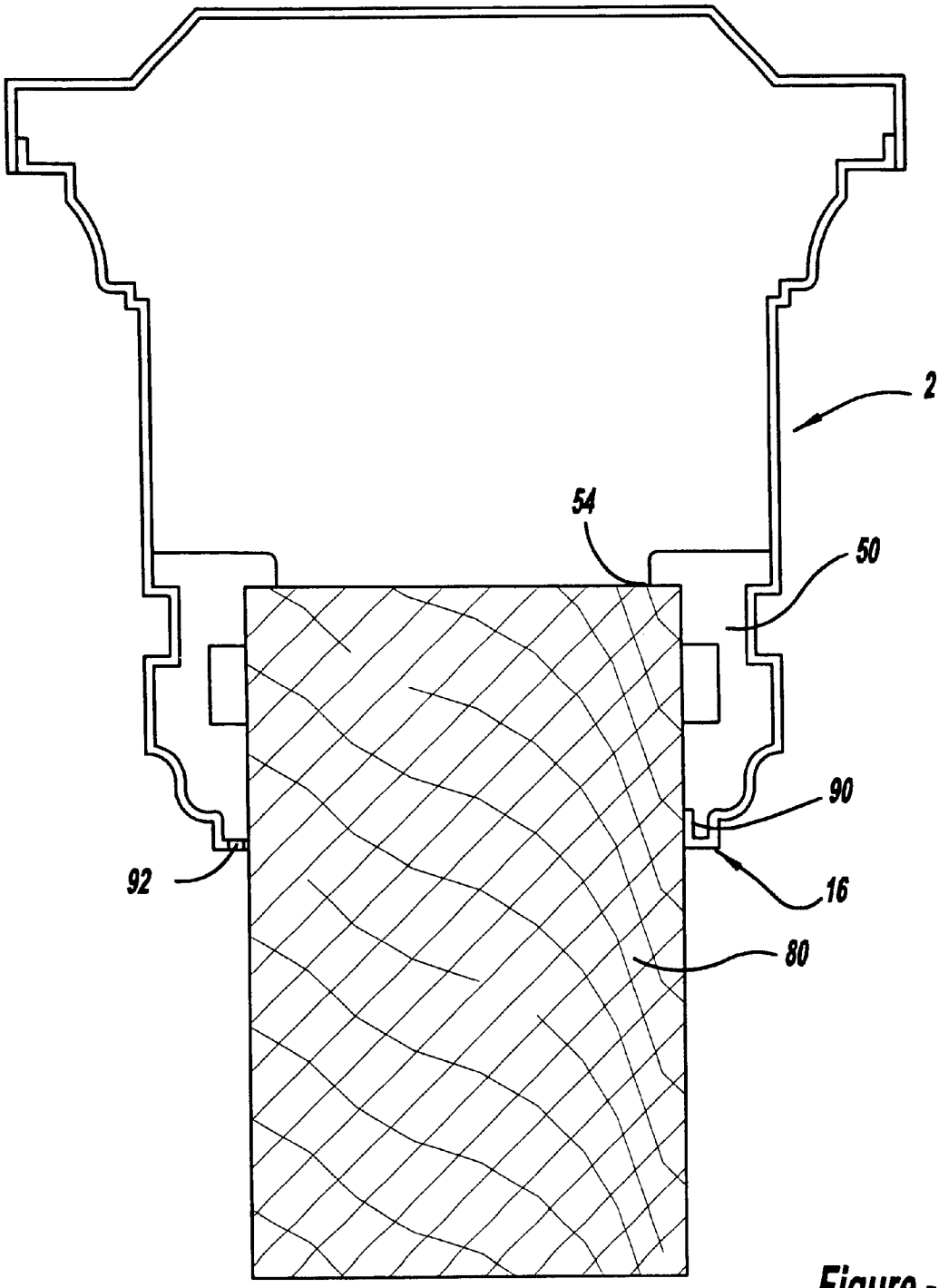
FIG. 5 is a cross section of a post cap with a lid taken along Line C—C of FIG. 2 installed on a post according to the present invention.

With continuing reference to FIGS. 1–5, and a particular reference to FIG. 5, the mounting position of the post cap 2 is illustrated. In particular, the post cap 2 is adapted to be mounted to a post 80. The post 80 is received through the bottom portion 10 of the post cap 2 and abuts against the bottom side 54 of the ribs 50. Therefore, the bottom side 54 of the ribs 50 stop the advancement of the post 80 into the post cap 2. Furthermore, the top volume 62 of the post cap 2 is then left open for the insertion of a light source 70. A first preferred embodiment of the present invention will include a flange 90 extending generally parallel to the outside of the post 80. This preferred embodiment is for particular use when the post 80 is formed of PVC or other polymeric material. The flange 90 receives an adhesive material for adhering the post cap 2 to the post 80. A second preferred embodiment includes a bore 92 through the bottom 10 of the post cap 2. The bore 92 would be placed on the post cap 2 when the post 80 is formed of a wood material. The bore 92 would receive a nail or other fastening means to affix the post cap 2 to the post 80.

Once the post cap 2 is affixed to the top of a post 80, a light source 70 may be inserted into the post cap 2 and mounted on the mounting member 60. However, it is to be understood that this is a selection which may be made by a final consumer. In particular, a consumer may purchase or receive the post cap 2 with the intent that initially a light source 70 will not be used. However, the post cap 2 may then later be adapted to be used with a light source 70. The cap 24 is selectively removable as are the removable portions 30. In this way, the consumer is given a greater variety of choices as to whether have a lighted post cap or simply a decorative post cap to place on top of a post 80.

The description of the invention is merely exemplary in nature and, thus, variations that do not depart from the invention are intended to be within the scope of the invention. For example, it is to be understood that the post cap 2 may have its dimensions varied greatly to receive different size posts while including all the features herein described. Such variations are not to be regarded as a departure from the spirit and scope of the invention.

What is claimed is:

1. A post cap assembly comprising:

a body including a generally vertical side having an inside surface defining an interior volume and an outside surface; and at least one locating member projecting inwardly from said inside surface and having a stop formed thereon, said stop dividing said interior volume into an upper portion and a lower portion, wherein said lower portion is adapted to receive a support and said upper portion is adapted to receive a light source;

wherein said body includes four of said generally vertical sides, wherein two of said generally vertical sides are perpendicularly affixed to one another at an end forming a unit; and two of said units are releasably affixed to one another substantially defining a cube.

2. The post cap of claim 1, wherein each of the vertical sides includes one of the at least one locating member.

3. The post cap of claim 1, where said generally vertical side includes an eave extending out from the outside and adjacent said upper portion.

4. The post cap of claim 3, wherein said eave includes a removable portion wherein the removable portion covers an aperture in the eave.

5. The post cap of claim 4, further comprising a shield, wherein the eave receives the shield.

6. The post cap of claim 1, further comprising a mounting member which is selectively positioned in said upper portion, wherein said mounting, member is adapted to receive a light source.

7. The post cap of claim 3, further comprises a reflective member selectively engagable with said eves.

8. The post cap of claim 7, wherein said reflective member is a cap, in releasable engagement with an outer perimeter of said eves.

9. An illuminated post cap comprising:

a body including a wall generally vertically oriented and having an inner surface defining an interior volume and an exterior surface, a divider disposed within said interior volume and dividing said interior volume into an upper portion and a lower portion, and an eave extending from said exterior surface of said wall and having an aperture formed therein;

a cap releasably secured over said body proximate to said eaves and enclosing said upper portion; and a light source disposed within said upper portion of said interior volume for projecting light from said interior volume through said aperture onto said exterior surface of said wall.

10. The illuminated post cap of claim 9, wherein said body is substantially opaque such that light projected from said light source is not transmitted through said wall.

11. The illuminated post cap of claim 9, wherein said divider is substantially opaque such that light projected from said light source is not transmitted into said lower portion of said interior volume.

12. The illuminated post cap of claim 9, further comprising a translucent lens covering said aperture.

13. The illuminated post cap of claim 9, wherein said eave is formed with a removable insert for creating said aperture.

14. The illuminated post cap of claim 9 wherein said aperture is generally rectangular.

15. The illuminated post cap of claim 14, wherein said aperture has an aspect ratio equal to or greater than 0.5:1.

16. The illuminated post cap of claim 9, wherein said cap has a light reflecting surface formed on a surface adjacent said upper portion of said interior volume.

17. The illuminated post cap of claim 9, further comprising a locating member disposed within said lower portion of said interior volume.

18. The illuminated post cap of claim 9, wherein said divider has a mount formed thereon for engaging said light source such that said light source is disposed in said upper portion.

19. A post cap able to be illuminated comprising:

an opaque cube defining an interior volume and including a top opening and a bottom opening;

each side of the opaque cube including an eave adjacent to the top opening and extending over the outside of the cube, wherein the eave includes an aperture selectively covered by a member;

an opaque divider disposed in said interior volume and dividing the interior volume into an upper portion and a lower portion, wherein the lower portion is adapted to receive a support, and the upper portion is adapted to receive a light source; and an opaque cap which releasably engages an outer perimeter of the eaves.

20. A post cap assembly comprising:

a body including a generally vertical side having an inside surface defining an interior volume and an outside surface; and at least one locating member projecting inwardly from said inside surface and having a stop formed thereon, said stop dividing said interior volume into an upper portion and a lower portion, wherein said lower portion is adapted to receive a support and said upper portion is adapted to receive a light source;

each of the plurality of generally vertical sides includes an eave extending out from the outside surface and adjacent said upper portion;

wherein each of the eaves includes a removable portion wherein the removable portion covers an aperture in the eave.

* * * * *